US010163447B2

(12) United States Patent
Krishnan et al.

(10) Patent No.: US 10,163,447 B2
(45) Date of Patent: Dec. 25, 2018

(54) HIGH-BAND SIGNAL MODELING

(71) Applicant: QUALCOMM Incorporated, San Diego, CA (US)

(72) Inventors: Venkatesh Krishnan, San Diego, CA (US); Venkatraman S. Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 274 days.

(21) Appl. No.: 14/568,359

(22) Filed: Dec. 12, 2014

(65) Prior Publication Data

US 2015/0170662 A1 Jun. 18, 2015

Related U.S. Application Data

(60) Provisional application No. 61/916,697, filed on Dec. 16, 2013.

(51) Int. Cl.
*G10L 21/038* (2013.01)
*G10L 19/02* (2013.01)
(Continued)

(52) U.S. Cl.
CPC ..... *G10L 19/02* (2013.01); *G10L 19/08* (2013.01); *G10L 21/0388* (2013.01);
(Continued)

(58) Field of Classification Search
CPC .... G10L 21/038; G10L 19/0204; G10L 19/04
See application file for complete search history.

(56) References Cited

U.S. PATENT DOCUMENTS 6,141,638 A 10/2000 Peng et al.
6,449,313 B1 9/2002 Erzin et al.
(Continued)

FOREIGN PATENT DOCUMENTS

WO 0223536 A2 3/2002
WO 2012158157 A1 11/2012

OTHER PUBLICATIONS

Blamey, et al., "Formant-Based Processing for Hearing Aids," Human Communication Research Centre, University of Melbourne, pp. 273-pp. 278, Jan. 1993.
(Continued)

*Primary Examiner* — Samuel G Neway
(74) *Attorney, Agent, or Firm* — Toler Law Group, P.C.

(57) ABSTRACT

A method includes filtering, at a speech encoder, an audio signal into a first group of sub-bands within a first frequency range and a second group of sub-bands within a second frequency range. The method also includes generating a harmonically extended signal based on the first group of sub-bands. The method further includes generating a third group of sub-bands based, at least in part, on the harmonically extended signal. The third group of sub-bands corresponds to the second group of sub-bands. The method also includes determining a first adjustment parameter for a first sub-band in the third group of sub-bands or a second adjustment parameter for a second sub-band in the third group of sub-bands. The first adjustment parameter is based on a metric of a first sub-band in the second group of sub-bands, and the second adjustment parameter is based on a metric of a second sub-band in the second group of sub-bands.

35 Claims, 7 Drawing Sheets

(51) Int. Cl.
*G10L 19/04* (2013.01)
*G10L 21/0388* (2013.01)
*G10L 19/08* (2013.01)

(52) U.S. Cl.
CPC ..... *G10L 19/0204* (2013.01); *G10L 19/04* (2013.01); *G10L 21/038* (2013.01)

(56) References Cited

U.S. PATENT DOCUMENTS

| | | | | |
|---|---|---|---|---|
| 6,629,068 | B1 | 9/2003 | Horos et al. | |
| 6,704,701 | B1 | 3/2004 | Gao | |
| 6,766,289 | B2 | 7/2004 | Kandhadai et al. | |
| 6,795,805 | B1 | 9/2004 | Bessette et al. | |
| 7,117,146 | B2 | 10/2006 | Gao | |
| 7,272,556 | B1 | 9/2007 | Aguilar et al. | |
| 7,680,653 | B2 | 3/2010 | Yeldener | |
| 7,788,091 | B2 | 8/2010 | Goudar et al. | |
| 2002/0147583 | A1 | 10/2002 | Gao | |
| 2003/0115042 | A1 | 6/2003 | Chen et al. | |
| 2003/0128851 | A1 | 7/2003 | Furuta | |
| 2004/0093205 | A1 | 5/2004 | Ashley et al. | |
| 2005/0004793 | A1* | 1/2005 | Ojala | G10L 21/038 704/219 |
| 2006/0147127 | A1 | 7/2006 | Edler et al. | |
| 2006/0173691 | A1 | 8/2006 | Mukaide | |
| 2006/0277038 | A1* | 12/2006 | Vos | G10L 19/0208 704/219 |
| 2007/0147518 | A1* | 6/2007 | Bessette | G10L 19/0212 375/243 |
| 2007/0282599 | A1* | 12/2007 | Choo | G10L 19/0208 704/205 |
| 2008/0027711 | A1* | 1/2008 | Rajendran | G10L 19/167 704/201 |
| 2008/0027718 | A1* | 1/2008 | Krishnan | G10L 21/038 704/211 |
| 2008/0114605 | A1 | 5/2008 | Wu et al. | |
| 2008/0120117 | A1* | 5/2008 | Choo | G10L 21/038 704/500 |
| 2008/0120118 | A1* | 5/2008 | Choo | G10L 19/0208 704/500 |
| 2008/0126081 | A1* | 5/2008 | Geiser | G10L 21/038 704/201 |
| 2008/0208575 | A1 | 8/2008 | Laaksonen et al. | |
| 2009/0254783 | A1 | 10/2009 | Hirschfeld et al. | |
| 2010/0241433 | A1 | 9/2010 | Herre et al. | |
| 2010/0332223 | A1 | 12/2010 | Morii et al. | |
| 2011/0099004 | A1 | 4/2011 | Krishnan et al. | |
| 2011/0295598 | A1* | 12/2011 | Yang | G10L 21/038 704/205 |
| 2012/0101824 | A1 | 4/2012 | Chen | |
| 2012/0221326 | A1 | 8/2012 | Grancharov et al. | |
| 2012/0300946 | A1 | 11/2012 | Ma | |
| 2012/0323571 | A1 | 12/2012 | Song et al. | |
| 2015/0106084 | A1* | 4/2015 | Atti | G10L 19/0208 704/226 |
| 2015/0170662 | A1* | 6/2015 | Krishnan | G10L 19/02 704/205 |

OTHER PUBLICATIONS

Boillot, et al., "A Loudness Enhancement Technique for Speech," IEEE, 0-7803-8251-X/04, ISCAS 2004, pp. V-616-pp. V-619, 2004.

Cheveigne, "Formant Bandwidth Affects the Identification of Competing Vowels," CNRS—IRCAM, France, and ATR-HIP, Japan, p. 1-p. 4, 1999.

Coelho, et al., "Voice Pleasantness: on the Improvement of TTS Voice Quality," Instituto Politécnico do Porto, ESEIG, Porto, Portugal, MLDC—Microsoft Language Development Center, Lisbon, Portugal, Universidade de Vigo, Dep. Teoria de la Señal e Telecomuniçõns, Vigo, Spain, p. 1-p. 6, download.microsoft.com/download/a/0/b/a0b1a66a-5ebf-4cf3-9453-4b13bb027f1f/jth08voicequality.pdf.

Cole, et al., "Speech Enhancement by Formant Sharpening in the Cepstral Domain," Proceedings of the 9th Australian International Conference on Speech Science & Technology, Australian Speech Science & Technology Association Inc., pp. 244-pp. 249, Melbourne, Australia, Dec. 2-5, 2002.

Cox, "Current Methods of Speech Coding," Signal Compression: Coding of Speech, Audio, Text, Image and Video, ed N. Jayant, ISBN-13: 9789810237653, vol. 7, No. 1, pp. 31-pp. 39, 1997.

ISO/IEC 14496-3:2005(E), Subpart 3: Speech Coding—CELP, pp. 1-165, 2005.

ITU-T, "Series G: Transmission Systems and Media, Digital Systems and Networks, Digital terminal equipments—Coding of analogue signals by methods other than PCM, Dual rate speech coder for multimedia communications transmitting at 5.3 and 6.3 kbit/s", G.723.1, ITU-T, pp. 1-pp. 64, May 2006.

Jokinen, et al., "Comparison of Post-Filtering Methods for Intelligibility Enhancement of Telephone Speech," 20th European Signal Processing Conference (EUSIPCO 2012), ISSN 2076-1465, p. 2333-p. 2337, Bucharest, Romania, Aug. 27-31, 2012.

Taniguchi T et AL, "Pitch Sharpeing for Perceptually Improved CELP, and the Sparse-Delta Codebook for Reduced Computation", Proceedings from the International Conference on Acoustics, Speech & Signal Processing, ICASSP, pp. 241-244, Apr. 14-17, 1991.

Zorila, et al., "Improving Speech Intelligibility in Noise Environments by Spectral Shaping and Dymanic Range Compression," The Listening Talker—An Interdisciplinary Workshop on Natural and Synthetic Modification of Speech, LISTA Workshop in Response to Listening Conditions. Edinburgh, May 2-3, 2012, pp. 1.

Zorila, et al., "Improving Sppech Intelligibility in Noise Environments by Spectral Shaping and Dynamic Range Compression," Forth—Institute of Computer Science, Listening Talker, pp. 1.

Zorila, et al., "Speech-In-Noise Intelligibility Improvement Based on Power Recovery and Dynamic Range Compression," 20th European Signal Processing Conference (EUSIPCO 2012), ISSN 2076-1465, pp. 2075-pp. 2079, Bucharest, Romania, Aug. 27-31, 2012.

"Subpart 3: Speech Coding—CELP," ISO/IEC 14496-3:2005(E), 2005, ISO/IEC, New York, New York, pp. 1-165.

"Dual Rate Speech Coder for Multimedia Communications Transmitting at 5.3 and 6.3 kbit/s," Series G: Transmission of Systems and Media, Digital Systems and Networks, Digital Terminal Equipments—Coding of Analogue Signals by Methods other than PCM, G.723.1, ITU-T, Telecommunication Standardization Sector of ITU, International Telecommunication Union, Geneva, Switzerland, May 2006, pp. 1-56.

International Search Report and Written Opinion—PCT/US2014/070268—ISA/EPO—Mar. 24, 2015, 14 pages.

Krishnan V., "EVRC-Wideband: The New 3GPP2 Wideband Vocoder Standard", IEEE International Conference on Acoustics, Speech and Signal Processing, ICASSP, 2007, vol. 2, Apr. 20, 2007, pp. II-333-II-336.

* cited by examiner

HIGH-BAND SIGNAL MODELING

I. CLAIM OF PRIORITY

The present application claims priority from U.S. Provisional Patent Application No. 61/916,697 entitled "HIGH-BAND SIGNAL MODELING," filed Dec. 16, 2013, the contents of which are incorporated by reference in their entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. However, in order to improve coding efficiency, the higher frequency portion of the signal (e.g., 7 kHz to 16 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc. Properties of the low-band signal may be used to generate the side information; however, energy disparities between the low-band and the high-band may result in side information that inaccurately characterizes the high-band.

IV. SUMMARY

Systems and methods for performing high-band signal modeling are disclosed. A first filter (e.g., a quadrature mirror filter (QMF) bank or a pseudo-QMF bank) may filter an audio signal into a first group of sub-bands corresponding to a low-band portion of the audio signal and a second group of sub-bands corresponding to a high-band portion of the audio signal. The group of sub-bands corresponding to the low band portion of the audio signal and the group of sub-bands corresponding to the high band portion of the audio signal may or may not have common sub-bands. A synthesis filter bank may combine the first group of sub-bands to generate a low-band signal (e.g., a low-band residual signal), and the low-band signal may be provided to a low-band coder. The low-band coder may quantize the low-band signal using a Linear Prediction Coder (LP Coder) which may generate a low-band excitation signal. A non-linear transformation process may generate a harmonically extended signal based on the low-band excitation signal. The bandwidth of the nonlinear excitation signal may be larger than the low band portion of the audio signal and even as much as that of the entire audio signal. For example, the non-linear transformation generator may up-sample the low-band excitation signal, and may process the up-sampled signal through a non-linear function to generate the harmonically extended signal having a bandwidth that is larger than the bandwidth of the low-band excitation signal.

In a particular embodiment, a second filter may split the harmonically extended signal into a plurality of sub-bands. In this embodiment, modulated noise may be added to each sub-band of the plurality of sub-bands of the harmonically extended signal to generate a third group of sub-bands corresponding to the second group of sub-bands (e.g., sub-bands corresponding to the high-band of the harmonically extended signal). In another particular embodiment, modulated noise may be mixed with the harmonically extended signal to generate a high-band excitation signal that is provided to the second filter. In this embodiment, the second filter may split the high-band excitation signal into the third group of sub-bands.

A first parameter estimator may determine a first adjustment parameter for a first sub-band in the third group of sub-bands based on a metric of a corresponding sub-band in the second group of sub-bands. For example, the first parameter estimator may determine a spectral relationship and/or a temporal envelope relationship between the first sub-band in the third group of sub-bands and a corresponding high-band portion of the audio signal. In a similar manner, a second parameter estimator may determine a second adjustment parameter for a second sub-band in the third group of sub-bands based on a metric of a corresponding sub-band in the second group of sub-bands. The adjustment parameters may be quantized and transmitted to a decoder along with other side information to assist the decoder in reconstructing the high-band portion of the audio signal.

In a particular aspect, a method includes filtering, at a speech encoder, an audio signal into a first group of sub-bands within a first frequency range and a second group of sub-bands within a second frequency range. The method also includes generating a harmonically extended signal based on the first group of sub-bands. The method further includes generating a third group of sub-bands based, at least in part, on the harmonically extended signal. The third group of sub-bands corresponds to the second group of sub-bands. The method also includes determining a first adjustment parameter for a first sub-band in the third group of sub-bands or a second adjustment parameter for a second sub-band in the third group of sub-bands. The first adjustment parameter is based on a metric of a first sub-band in the second group of sub-bands, and the second adjustment parameter is based on a metric of a second sub-band in the second group of sub-bands.

In another particular aspect, an apparatus includes a first filter configured to filter an audio signal into a first group of sub-bands within a first frequency range and a second group of sub-bands within a second frequency range. The apparatus also includes a non-linear transformation generator configured to generate a harmonically extended signal based on the first group of sub-bands. The apparatus further includes a second filter configured to generate a third group of sub-bands based, at least in part, on the harmonically extended signal. The third group of sub-bands corresponds to the second group of sub-bands. The apparatus also includes parameter estimators configured to determine a first adjustment parameter for a first sub-band in the third group of sub-bands or a second adjustment parameter for a second sub-band in the third group of sub-bands. The first adjustment parameter is based on a metric of a first sub-band in the second group of sub-bands, and the second adjustment parameter is based on a metric of a second sub-band in the second group of sub-bands.

In another particular aspect, a non-transitory computer-readable medium includes instructions that, when executed by a processor at a speech encoder, cause the processor to filter an audio signal into a first group of sub-bands within a first frequency range and a second group of sub-bands within a second frequency range. The instructions are also executable to cause the processor to generate a harmonically extended signal based on the first group of sub-bands. The instructions are further executable to cause the processor to generate a third group of sub-bands based, at least in part, on the harmonically extended signal. The third group of sub-bands corresponds to the second group of sub-bands. The instructions are also executable to cause the processor to determine a first adjustment parameter for a first sub-band in the third group of sub-bands or a second adjustment parameter for a second sub-band in the third group of sub-bands. The first adjustment parameter is based on a metric of a first sub-band in the second group of sub-bands, and the second adjustment parameter is based on a metric of a second sub-band in the second group of sub-bands.

In another particular aspect, an apparatus includes means for filtering an audio signal into a first group of sub-bands within a first frequency range and a second group of sub-bands within a second frequency range. The apparatus also includes means for generating a harmonically extended signal based on the first group of sub-bands. The apparatus further includes means for generating a third group of sub-bands based, at least in part, on the harmonically extended signal. The third group of sub-bands corresponds to the second group of sub-bands. The apparatus also includes means for determining a first adjustment parameter for a first sub-band in the third group of sub-bands or a second adjustment parameter for a second sub-band in the third group of sub-bands. The first adjustment parameter is based on a metric of a first sub-band in the second group of sub-bands, and the second adjustment parameter is based on a metric of a second sub-band in the second group of sub-bands.

In another particular aspect, a method includes generating, at a speech decoder, a harmonically extended signal based on a low-band excitation signal generated by a Linear Prediction based decoder based on the parameters received from a speech encoder. The method further includes generating a group of high-band excitation sub-bands based, at least in part, on the harmonically extended signal. The method also includes adjusting the group of high-band excitation sub-bands based on adjustment parameters received from the speech encoder.

In another particular aspect, an apparatus includes a non-linear transformation generator configured to generate a harmonically extended signal based on a low-band excitation signal generated by a Linear Prediction based decoder based on the parameters received from a speech encoder. The apparatus further includes a second filter configured to generate a group of high-band excitation sub-bands based, at least in part, on the harmonically extended signal. The apparatus also includes adjusters configured to adjust the group of high-band excitation sub-bands based on adjustment parameters received from the speech encoder.

In another particular aspect, an apparatus includes means for generating a harmonically extended signal based on a low-band excitation signal generated by a Linear Prediction based decoder based on the parameters received from a speech encoder. The apparatus further includes means for generating a group of high-band excitation sub-bands based, at least in part, on the harmonically extended signal. The apparatus also includes means for adjusting the group of high-band excitation sub-bands based on adjustment parameters received from the speech encoder.

In another particular aspect, a non-transitory computer-readable medium includes instructions that, when executed by a processor at a speech decoder, cause the processor to generate a harmonically extended signal based on a low-band excitation signal generated by a Linear Prediction based decoder based on the parameters received from a speech encoder. The instructions are further executable to cause the processor to generate a group of high-band excitation sub-bands based, at least in part, on the harmonically extended signal. The instructions are also executable to cause the processor to adjust the group of high-band excitation sub-bands based on adjustment parameters received from the speech encoder.

Particular advantages provided by at least one of the disclosed embodiments include improved resolution modeling of a high-band portion of an audio signal. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
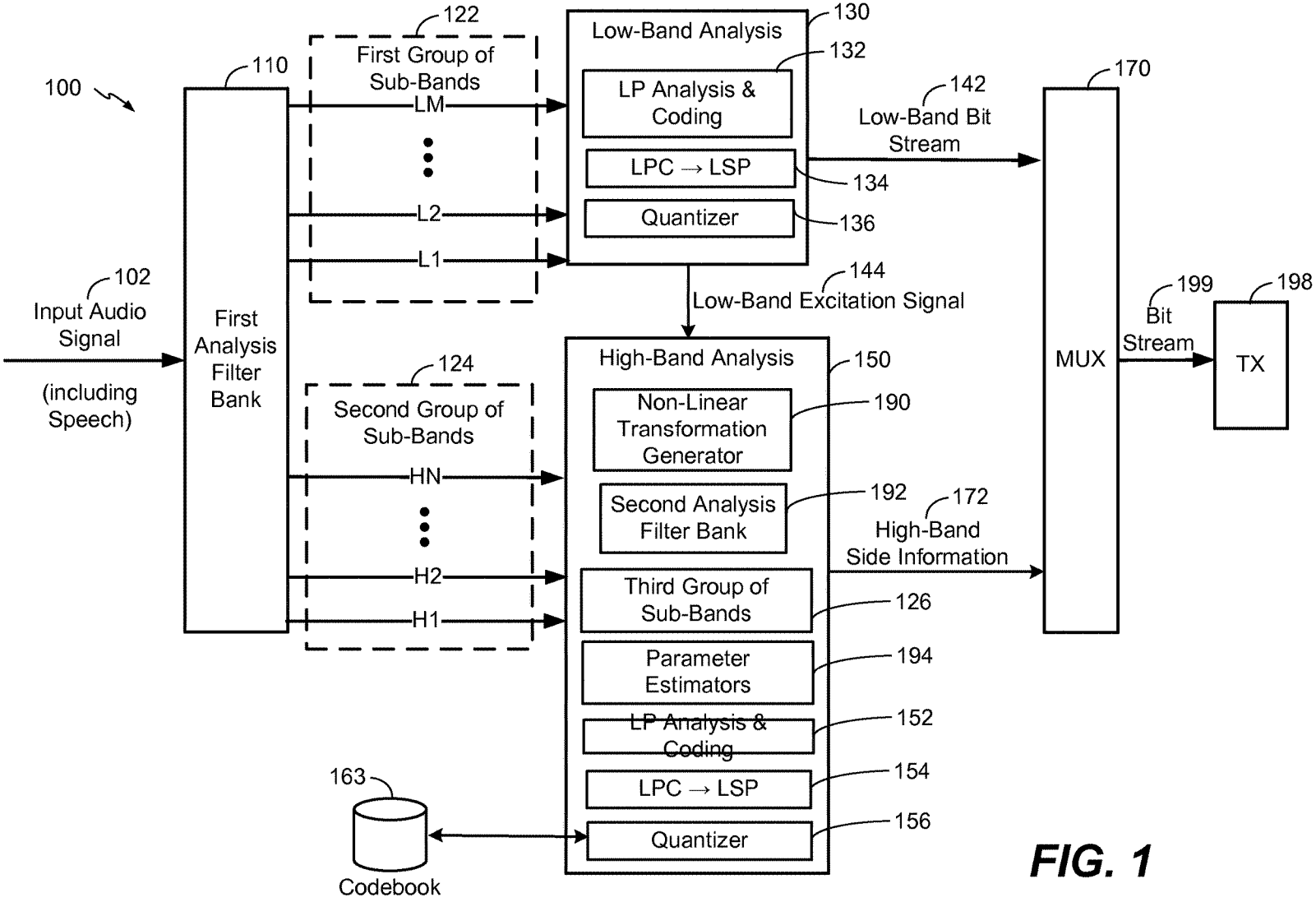
FIG. 1 is a diagram to illustrate a particular embodiment of a system that is operable to perform high-band signal modeling.

Referring to FIG. 1, a particular embodiment of a system that is operable to perform high-band signal modeling is shown and generally designated 100. In a particular embodiment, the system 100 may be integrated into an encoding system or apparatus (e.g., in a wireless telephone or coder/decoder (CODEC)). In other embodiments, the system 100 may be integrated into a set top box, a music player, a video player, an entertainment unit, a navigation device, a communications device, a PDA, a fixed location data unit, or a computer.

It should be noted that in the following description, various functions performed by the system 100 of FIG. 1 are described as being performed by certain components or modules. However, this division of components and modules is for illustration only. In an alternate embodiment, a function performed by a particular component or module may instead be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes a first analysis filter bank 110 (e.g., a QMF bank or a pseudo-QMF bank) that is configured to receive an input audio signal 102. For example, the input audio signal 102 may be provided by a microphone or other input device. In a particular embodiment, the input audio signal 102 may include speech. The input audio signal 102 may be a SWB signal that includes data in the frequency range from approximately 50 Hz to approximately 16 kHz. The first analysis filter bank 110 may filter the input audio signal 102 into multiple portions based on frequency. For example, the first analysis filter bank 110 may generate a first group of sub-bands 122 within a first frequency range and a second group of sub-bands 124 within a second frequency range. The first group of sub-bands 122 may include M sub-bands, where M is an integer that is greater than zero. The second group of sub-bands 124 may include N sub-bands, where N is an integer that is greater than one. Thus, the first group of sub-bands 122 may include at least one sub-band, and the second group of sub-bands 124 include two or more sub-bands. In a particular embodiment, M and N may be a similar value. In another particular embodiment, M and N may be different values. The first group of sub-bands 122 and the second group of sub-bands 124 may have equal or unequal bandwidth, and may be overlapping or non-overlapping. In an alternate embodiment, the first analysis filter bank 110 may generate more than two groups of sub-bands.

The first frequency range may be lower than the second frequency range. In the example of FIG. 1, the first group of sub-bands 122 and the second group of sub-bands 124 occupy non-overlapping frequency bands. For example, the first group of sub-bands 122 and the second group of sub-bands 124 may occupy non-overlapping frequency bands of 50 Hz-7 kHz and 7 kHz-16 kHz, respectively. In an alternate embodiment, the first group of sub-bands 122 and the second group of sub-bands 124 may occupy non-overlapping frequency bands of 50 Hz-8 kHz and 8 kHz-16 kHz, respectively. In another alternate embodiment, the first group of sub-bands 122 and the second group of sub-bands 124 overlap (e.g., 50 Hz-8 kHz and 7 kHz-16 kHz, respectively), which may enable a low-pass filter and a high-pass filter of the first analysis filter bank 110 to have a smooth rolloff, which may simplify design and reduce cost of the low-pass filter and the high-pass filter. Overlapping the first group of sub-bands 122 and the second group of sub-bands 124 may also enable smooth blending of low-band and high-band signals at a receiver, which may result in fewer audible artifacts.

It should be noted that although the example of FIG. 1 illustrates processing of a SWB signal, this is for illustration only. In an alternate embodiment, the input audio signal 102 may be a WB signal having a frequency range of approximately 50 Hz to approximately 8 kHz. In such an embodiment, the first group of sub-bands 122 may correspond to a frequency range of approximately 50 Hz to approximately 6.4 kHz and the second group of sub-bands 124 may correspond to a frequency range of approximately 6.4 kHz to approximately 8 kHz.

The system 100 may include a low-band analysis module 130 configured to receive the first group of sub-bands 122. In a particular embodiment, the low-band analysis module 130 may represent an embodiment of a code excited linear prediction (CELP) encoder. The low-band analysis module 130 may include a linear prediction (LP) analysis and coding module 132, a linear prediction coefficient (LPC) to LSP transform module 134, and a quantizer 136. LSPs may also be referred to as LSFs, and the two terms (LSP and LSF) may be used interchangeably herein. The LP analysis and coding module 132 may encode a spectral envelope of the first group of sub-bands 122 as a set of LPCs. LPCs may be generated for each frame of audio (e.g., 20 milliseconds (ms) of audio, corresponding to 320 samples at a sampling rate of 16 kHz), each sub-frame of audio (e.g., 5 ms of audio), or any combination thereof. The number of LPCs generated for each frame or sub-frame may be determined by the "order" of the LP analysis performed. In a particular embodiment, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the LPC to LSP transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 thus represents low-band filter parameters that are included in a low-band bit stream 142.

The low-band analysis module 130 may also generate a low-band excitation signal 144. For example, the low-band excitation signal 144 may be an encoded signal that is generated by coding a LP residual signal that is generated during the LP process performed by the low-band analysis module 130.

The system 100 may further include a high-band analysis module 150 configured to receive the second group of sub-bands 124 from the first analysis filter bank 110 and the low-band excitation signal 144 from the low-band analysis module 130. The high-band analysis module 150 may generate high-band side information 172 based on the second group of sub-bands 124 and the low-band excitation signal 144. For example, the high-band side information 172 may include high-band LPCs and/or gain information (e.g., adjustment parameters).

The high-band analysis module 150 may include a non-linear transformation generator 190. The non-linear transformation generator 190 may be configured to generate a harmonically extended signal based on the low-band excitation signal 144. For example, the non-linear transformation generator 190 may up-sample the low-band excitation signal 144 and may process the up-sampled signal through a non linear function to generate the harmonically extended signal having a bandwidth that is larger than the bandwidth of the low-band excitation signal 144.

The high-band analysis module 150 may also include a second analysis filter bank 192. In a particular embodiment, the second analysis filter bank 192 may split the harmonically extended signal into a plurality of sub-bands. In this embodiment, modulated noise may be added to each sub-band of the plurality of sub-bands to generate a third group of sub-bands 126 (e.g., high-band excitation signals) corresponding to the second group of sub-bands 124. As a non-limiting example, a first sub-band (H1) of the second group of sub-bands 124 may have a bandwidth ranging from 7 kHz to 8 kHz, and a second sub-band (H2) of the second group of sub-bands 124 may have a bandwidth ranging from 8 kHz to 9 kHz. Similarly, a first sub-band (not shown) of the third group of sub-bands 126 (corresponding to the first sub-band (H1)) may have a bandwidth ranging from 7 kHz to 8 kHz, and a second sub-band (not shown) of the third group of sub-bands 126 (corresponding to the second sub-band (H2)) may have a bandwidth ranging from 8 kHz to 9 kHz. In another particular embodiment, modulated noise may be mixed with the harmonically extended signal to generate a high-band excitation signal that is provided to the second analysis filter bank 192. In this embodiment, the second analysis filter bank 192 may split the high-band excitation signal into the third group of sub-bands 126.

Parameter estimators 194 within the high-band analysis module 150 may determine a first adjustment parameter (e.g., an LPC adjustment parameter and/or a gain adjustment parameter) for a first sub-band in the third group of sub-bands 126 based on a metric of a corresponding sub-band in the second group of sub-bands 124. For example, a particular parameter estimator may determine a spectral relationship and/or an envelope relationship between the first sub-band in the third group of sub-bands 126 and a corresponding high-band portion of the input audio signal 102 (e.g., a corresponding sub-band in the second group of sub-bands 124). In a similar manner, another parameter estimator may determine a second adjustment parameter for a second sub-band in the third group of sub-bands 126 based on a metric of a corresponding sub-band in the second group of sub-bands 124. As used herein, a "metric" of a sub-band may correspond to any value that characterizes the sub-band. As non-limiting examples, a metric of a sub-band may correspond to a signal energy of the sub-band, a residual energy of the sub-band, LP coefficients of the sub-band, etc.

In a particular embodiment, the parameter estimators 194 may calculate at least two gain factors (e.g., adjustment parameters) according to a relationship between sub-bands of the second group of sub-bands 124 (e.g., components of the high-band portion of the input audio signal 102) and corresponding sub-bands of the third group of sub-bands 126 (e.g., components of the high-band excitation signal). The gain factors may correspond to a difference (or ratio) between the energies of the corresponding sub-bands over a frame or some portion of the frame. For example, the parameter estimators 194 may calculate the energy as a sum of the squares of samples of each sub-frame for each sub-band, and the gain factor for the respective sub-frame may be the square root of the ratio of those energies. In another particular embodiment, the parameter estimators 194 may calculate a gain envelope according to a time varying relation between sub-bands of the second group of sub-bands 124 and corresponding sub-bands of the third group of sub-bands 126. However, the temporal envelope of the high-band portion of the input audio signal 102 (e.g., the high-band signal) and the temporal envelop of the high-band excitation signal are likely to be similar.

In another particular embodiment, the parameter estimators 194 may include an LP analysis and coding module 152 and a LPC to LSP transform module 154. Each of the LP analysis and coding module 152 and the LPC to LSP transform module 154 may function as described above with reference to corresponding components of the low-band analysis module 130, but at a comparatively reduced resolution (e.g., using fewer bits for each coefficient, LSP, etc.). The LP analysis and coding module 152 may generate a set of LPCs that are transformed to LSPs by the transform module 154 and quantized by a quantizer 156 based on a codebook 163. For example, the LP analysis and coding module 152, the LPC to LSP transform module 154, and the quantizer 156 may use the second group of sub-bands 124 to determine high-band filter information (e.g., high-band LSPs or adjustment parameters) and/or high-band gain information that is included in the high-band side information 172.

The quantizer 156 may be configured to quantize the adjustment parameters from the parameter estimators 194 as high-band side information 172. The quantizer may also be configured to quantize a set of spectral frequency values, such as LSPs provided by the transform module 154. In other embodiments, the quantizer 156 may receive and quantize sets of one or more other types of spectral frequency values in addition to, or instead of, LSFs or LSPs. For example, the quantizer 156 may receive and quantize a set of LPCs generated by the LP analysis and coding module 152. Other examples include sets of parcor coefficients, log-area-ratio values, and ISFs that may be received and quantized at the quantizer 156. The quantizer 156 may include a vector quantizer that encodes an input vector (e.g., a set of spectral frequency values in a vector format) as an index to a corresponding entry in a table or codebook, such as the codebook 163. As another example, the quantizer 156 may be configured to determine one or more parameters from which the input vector may be generated dynamically at a decoder, such as in a sparse codebook embodiment, rather than retrieved from storage.

To illustrate, sparse codebook examples may be applied in coding schemes such as CELP and codecs according to industry standards such as 3 GPP2 (Third Generation Partnership 2) EVRC (Enhanced Variable Rate Codec). In another embodiment, the high-band analysis module 150 may include the quantizer 156 and may be configured to use a number of codebook vectors to generate synthesized signals (e.g., according to a set of filter parameters) and to select one of the codebook vectors associated with the synthesized signal that best matches the second group of sub-bands 124, such as in a perceptually weighted domain.

In a particular embodiment, the high-band side information 172 may include high-band LSPs as well as high-band gain parameters. For example, the high-band side information 172 may include the adjustment parameters generated by the parameter estimators 194.

The low-band bit stream 142 and the high-band side information 172 may be multiplexed by a multiplexer (MUX) 170 to generate an output bit stream 199. The output bit stream 199 may represent an encoded audio signal corresponding to the input audio signal 102. For example, the multiplexer 170 may be configured to insert the adjustment parameters included in the high-band side information 172 into an encoded version of the input audio signal 102 to enable gain adjustment (e.g., envelope-based adjustment) and/or linearity adjustment (e.g., spectral-based adjustment) during reproduction of the input audio signal 102. The output bit stream 199 may be transmitted (e.g., over a wired, wireless, or optical channel) by a transmitter 198 and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 199 may represent low-band data. The high-band side information 172 may be used at a receiver to regenerate the high-band excitation signal from the low-band data in accordance with a signal model. For example, the signal model may represent an expected set of relationships or correlations between low-band data (e.g., the first group of sub-bands 122) and high-band data (e.g., the second group of sub-bands 124). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the second group of sub-bands 124 from the output bit stream 199.

The system 100 of FIG. 1 may improve correlation between synthesized high-band signal components (e.g., the third group of sub-bands 126) and original high-band signal components (e.g., the second group of sub-bands 124). For example, spectral and envelope approximation between the synthesized high-band signal components and the original high-band signal components may be performed on a "finer" level by comparing metrics of the second group of sub-bands 124 with metrics of the third group of sub-bands 126 on a sub-band by sub-band basis. The third group of sub-bands 126 may be adjusted based on adjustment parameters resulting from the comparison, and the adjustment parameters may be transmitted to a decoder to reduce audible artifacts during high-band reconstruction of the input audio signal 102.

Figure 2:
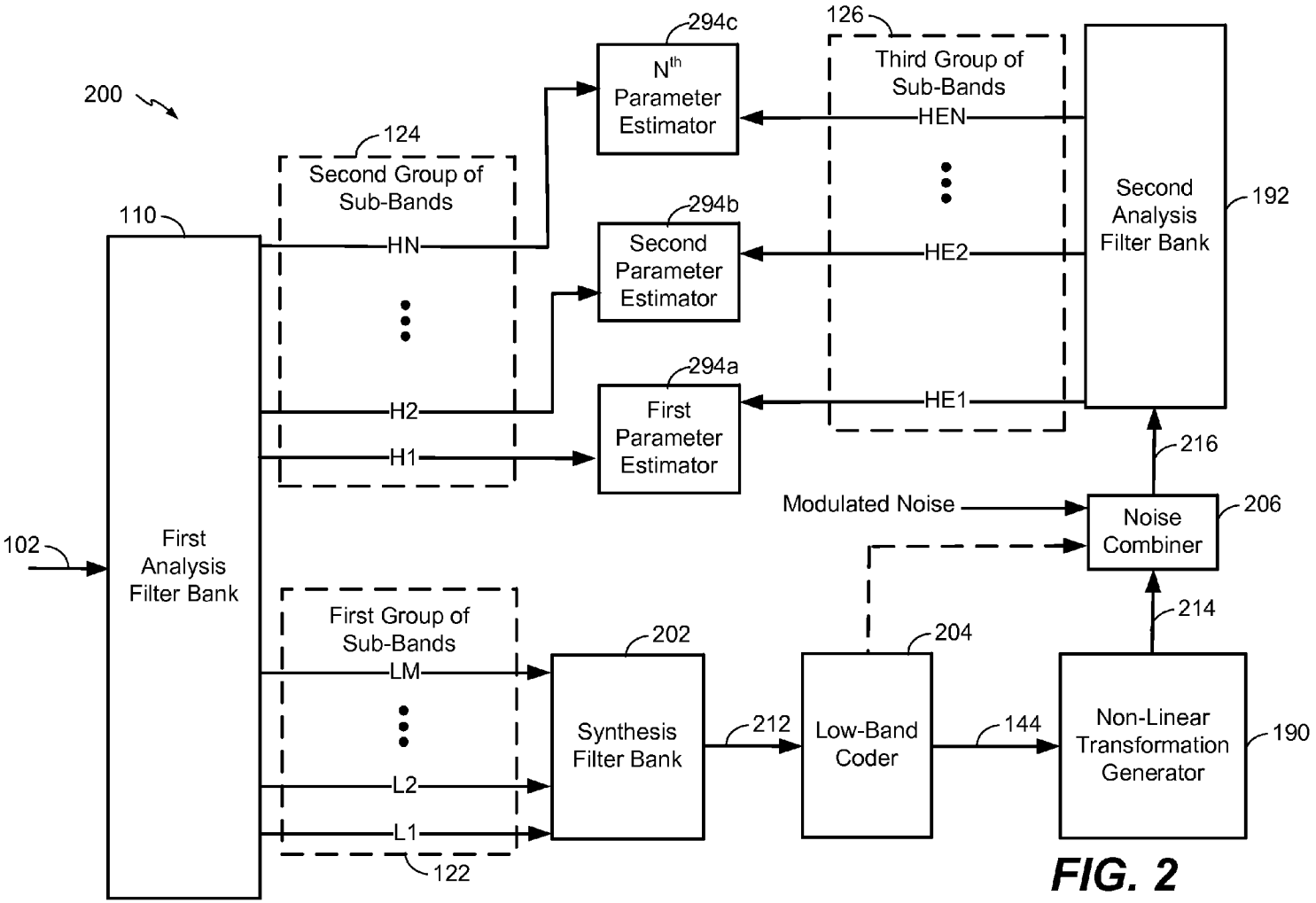
FIG. 2 is a diagram of another particular embodiment of a system that is operable to perform high-band signal modeling.

Referring to FIG. 2, a particular embodiment of a system 200 that is operable to perform high-band signal modeling is shown. The system 200 includes the first analysis filter bank 110, a synthesis filter bank 202, a low-band coder 204, the non-linear transformation generator 190, a noise combiner 206, a second analysis filter bank 192, and N parameter estimators 294*a*-294*c*.

The first analysis filter bank 110 may receive the input audio signal 102 and may be configured to filter the input audio signal 102 into multiple portions based on frequency. For example, the first analysis filter bank 110 may generate the first group of sub-bands 122 within the low-band frequency range and the second group of sub-bands 124 within the high-band frequency range. As a non-limiting example, the low-band frequency range may be from approximately 0 kHz to 6.4 kHz, and the high-band frequency range may be from approximately 6.4 kHz to 12.8 kHz. The first group of sub-bands 124 may be provided to the synthesis filter bank 202. The synthesis filter bank 202 may be configured generate a low-band signal 212 by combining the first group of sub-bands 122. The low-band signal 212 may be provided to the low-band coder 204.

The low-band coder 204 may correspond to the low-band analysis module 130 of FIG. 1. For example, the low-band coder 204 may be configured to quantize the low-band signal 212 (e.g., the first group of sub-bands 122) to generate the low-band excitation signal 144. The low-band excitation signal 144 may be provided to the non-linear transformation generator 190.

As described with respect to FIG. 1, the low-band excitation signal 144 may be generated from the first group of sub-bands 122 (e.g., the low-band portion of the input audio signal 102) using the low-band analysis module 130. The non-linear transformation generator 190 may be configured to generate a harmonically extended signal 214 (e.g., a non-linear excitation signal) based on the low-band excitation signal 144 (e.g., the first group of sub-bands 122). The non-linear transformation generator 190 may up-sample the low-band excitation signal 144 and may process the up-sampled signal using a non linear function to generate the harmonically extended signal 214 having a bandwidth that is larger than the bandwidth of the low-band excitation signal 144. For example, in a particular embodiment, the bandwidth of the low-band excitation signal 144 may be from approximately 0 to 6.4 kHz, and the bandwidth of the harmonically extended signal 214 may be from approximately 6.4 kHz to 16 kHz. In another particular embodiment, the bandwidth of the harmonically extended signal 214 may be higher than the bandwidth of the low-band excitation signal with an equal magnitude. For example, the bandwidth the of the low-band excitation signal 144 may be from approximately 0 to 6.4 kHz, and the bandwidth of the harmonically extended signal 214 may be from approximately 6.4 kHz to 12.8 kHz. In a particular embodiment, the non-linear transformation generator 190 may perform an absolute-value operation or a square operation on frames (or sub-frames) of the low-band excitation signal 144 to generate the harmonically extended signal 214. The harmonically extended signal 214 may be provided to the noise combiner 206.

The noise combiner 206 may be configured to mix the harmonically extended signal 214 with modulated noise to generate a high-band excitation signal 216. The modulated noise may be based on an envelope of the low-band signal 212 and white noise. The amount of modulated noise that is mixed with the harmonically extended signal 214 may be based on a mixing factor. The low-band coder 204 may generate information used by the noise combiner 206 to determine the mixing factor. The information may include a pitch lag in the first group of sub-bands 122, an adaptive codebook gain associated with the first group of sub-bands 122, a pitch correlation between the first group of sub-bands 122 and the second group of sub-bands 124, any combination thereof, etc. For example, if a harmonic of the low-band signal 212 corresponds to a voiced signal (e.g., a signal with relatively strong voiced components and relatively weak noise-like components), the value of the mixing factor may increase and a smaller amount of modulated noise may be mixed with the harmonically extended signal 214. Alternatively, if the harmonic of the low-band signal 212 corresponds to a noise-like signal (e.g., a signal with relatively strong noise-like components and relatively weak voiced components), the value of the mixing factor may decrease and a larger amount of modulated noise may be mixed with the harmonically extended signal 214. The high-band excitation signal 216 may be provided to the second analysis filter bank 192.

The second filter analysis filter bank 192 may be configured to filter (e.g., split) the high-band excitation signal 216 into the third group of sub-bands 126 (e.g., high-band excitation signals) corresponding to the second group of sub-bands 124. Each sub-band (HE1-HEN) of the third group of sub-bands 126 may be provided to a corresponding parameter estimator 294*a*-294*c*. In addition, each sub-band (H1-HN) of the second group of sub-bands 124 may be provided to the corresponding parameter estimator 294*a*-294*c*.

The parameter estimators 294*a*-294*c* may correspond to the parameter estimators 194 of FIG. 1 and may operate in a substantially similar manner. For example, each parameter estimator 294*a*-294*c* may determine adjustment parameters for corresponding sub-bands in the third group of sub-bands 126 based on a metric of corresponding sub-bands in the second group of sub-bands 124. For example, the first parameter estimator 294*a* may determine a first adjustment parameter (e.g., an LPC adjustment parameter and/or a gain adjustment parameter) for the first sub-band (HE1) in the third group of sub-bands 126 based on a metric of the first sub-band (H1) in the second group of sub-bands 124. For example, the first parameter estimator 294*a* may determine a spectral relationship and/or an envelope relationship between the first sub-band (HE1) in the third group of sub-bands 126 and the first sub-band (H1) in the second group of sub-bands 124. To illustrate, the first parameter estimator 294 may perform LP analysis on the first sub-band (H1) of the second group of sub-bands 124 to generate LPCs for the first sub-band (H1) and a residual for the first sub-band (H1). The residual for the first sub-band (H1) may be compared to the first sub-band (HE1) in the third group of sub-bands 126, and the first parameter estimator 294 may determine a gain parameter to substantially match an energy of the residual of the first sub-band (H1) of the second group of sub-bands 124 and an energy of the first sub-band (HE1) of the third group of sub-bands 126. As another example, the first parameter estimator 294 may perform synthesis using the first sub-band (HE1) of the third group of sub-bands 126 to generate a synthesized version of the first sub-band (H1) of the second group of sub-bands 124. The first parameter estimator 294 may determine a gain parameter such that an energy of the first sub-band (H1) of the second group of sub-bands 124 is approximate to an energy of the synthesized version of the first sub-band (H1). In a similar manner, the second parameter estimator 294*b* may determine a second adjustment parameter for the second sub-band (HE2) in the third group of sub-bands 126 based on a metric of the second sub-band (H2) in the second group of sub-bands 124.

The adjustment parameters may be quantized by a quantizer (e.g., the quantizer 156 of FIG. 1) and transmitted as the high-band side information. The third group of sub-bands 126 may also be adjusted based on the adjustment parameters for further processing (e.g., gain shape adjustment processing, phase adjustment processing, etc.) by other components (not shown) of the encoder (e.g., the system 200).

The system 200 of FIG. 2 may improve correlation between synthesized high-band signal components (e.g., the third group of sub-bands 126) and original high-band signal components (e.g., the second group of sub-bands 124). For example, spectral and envelope approximation between the synthesized high-band signal components and the original high-band signal components may be performed on a "finer" level by comparing metrics of the second group of sub-bands 124 with metrics of the third group of sub-bands 126 on a sub-band by sub-band basis. The third group of sub-bands 126 may be adjusted based on adjustment parameters resulting from the comparison, and the adjustment parameters may be transmitted to a decoder to reduce audible artifacts during high-band reconstruction of the input audio signal 102.

Figure 3:
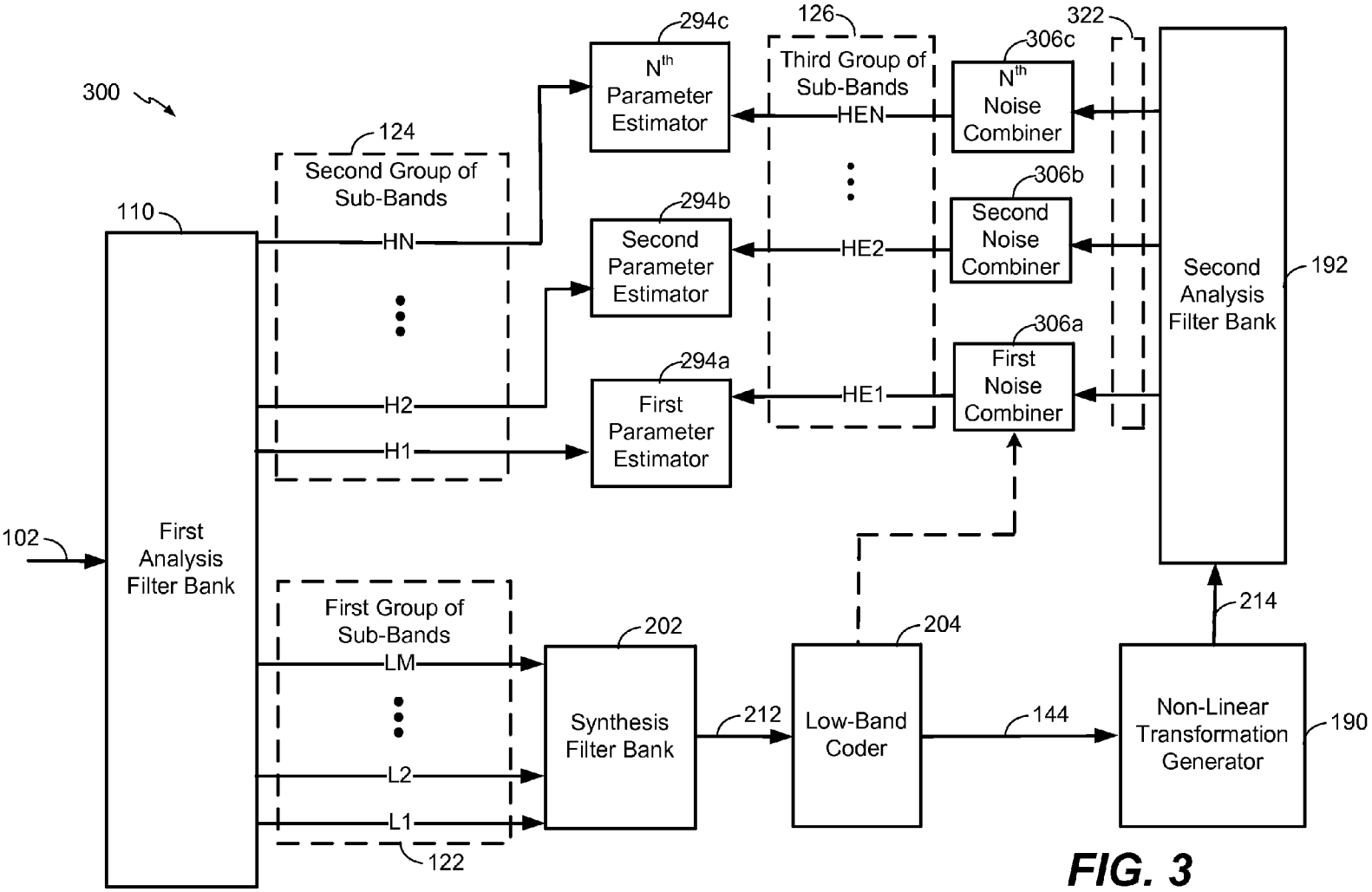
FIG. 3 is a diagram of another particular embodiment of a system that is operable to perform high-band signal modeling.

Referring to FIG. 3, a particular embodiment of a system 300 that is operable to perform high-band signal modeling is shown. The system 300 includes the first analysis filter bank 110, the synthesis filter bank 202, the low-band coder 204, the non-linear transformation generator 190, the second analysis filter bank 192, N noise combiners 306*a*-306*c*, and the N parameter estimators 294*a*-294*c*.

During operation of the system 300, the harmonically extended signal 214 is provided to the second analysis filter bank 192 (as opposed to the noise combiner 206 of FIG. 2). The second filter analysis filter bank 192 may be configured to filter (e.g., split) the harmonically extended signal 214 into a plurality of sub-bands 322. Each sub-band of the plurality of sub-bands 322 may be provided to a corresponding noise combiner 306*a*-306*c*. For example, a first sub-band of the plurality of sub-bands 322 may be provided to the first noise combiner 306*a*, a second sub-band of the plurality of sub-bands 322 may be provided to the second noise combiner 306*b*, etc.

Each noise combiner 306*a*-306*c* may be configured to mix the received sub-band of the plurality of sub-bands 322 with modulated noise to generate the third group of sub-bands 126 (e.g., a plurality of high-band excitation signals (HE1-HEN)). For example, the modulated noise may be based on an envelope of the low-band signal 212 and white noise. The amount of modulated noise that is mixed with each sub-band of the plurality of sub-bands 322 may be based on at least one mixing factor. In a particular embodiment, the first sub-band (HE1) of the third group of sub-bands 126 may be generated by mixing the first sub-band of the plurality of sub-bands 322 based on a first mixing factor, and the second sub-band (HE2) of the third group of sub-bands 126 may be generated by mixing the second sub-band of the plurality of sub-bands 322 based on a second mixing factor. Thus, multiple (e.g., different) mixing factors may be used to generate the third group of sub-bands 126.

The low-band coder 204 may generate information used by each noise combiner 306*a*-306*c* to determine the respective mixing factors. For example, the information provided to the first noise combiner 306*a* for determining the first mixing factor may include a pitch lag, an adaptive codebook gain associated with the first sub-band (L1) of the first group of sub-bands 122, a pitch correlation between the first sub-band (L1) of the first group of sub-bands 122 and the first sub-band (H1) of the second group of sub-bands 124, or any combination thereof. Similar parameters for respective sub-bands may be used to determine the mixing factors for the other noise combiners 306*b*, 306*n*. In another embodiment, each noise combiner 306*a*-306*n* may perform mixing operations based on a common mixing factor.

As described with respect to FIG. 2, each parameter estimator 294*a*-294*c* may determine adjustment parameters for corresponding sub-bands in the third group of sub-bands 126 based on a metric of corresponding sub-bands in the second group of sub-bands 124. The adjustment parameters may be quantized by a quantizer (e.g., the quantizer 156 of FIG. 1) and transmitted as the high-band side information. The third group of sub-bands 126 may also be adjusted based on the adjustment parameters for further processing (e.g., gain shape adjustment processing, phase adjustment processing, etc.) by other components (not shown) of the encoder (e.g., the system 300).

The system 300 of FIG. 3 may improve correlation between synthesized high-band signal components (e.g., the third group of sub-bands 126) and original high-band signal components (e.g., the second group of sub-bands 124). For example, spectral and envelope approximation between the synthesized high-band signal components and the original high-band signal components may be performed on a "finer" level by comparing metrics of the second group of sub-bands 124 with metrics of the third group of sub-bands 126 on a sub-band by sub-band basis. Further, each sub-band (e.g., high-band excitation signal) in the third group of sub-bands 126 may be generated based on characteristics (e.g., pitch values) of corresponding sub-bands within the first group of sub-bands 122 and the second group of sub-bands 124 to improve signal estimation. The third group of sub-bands 126 may be adjusted based on adjustment parameters resulting from the comparison, and the adjustment parameters may be transmitted to a decoder to reduce audible artifacts during high-band reconstruction of the input audio signal 102.

Figure 4:
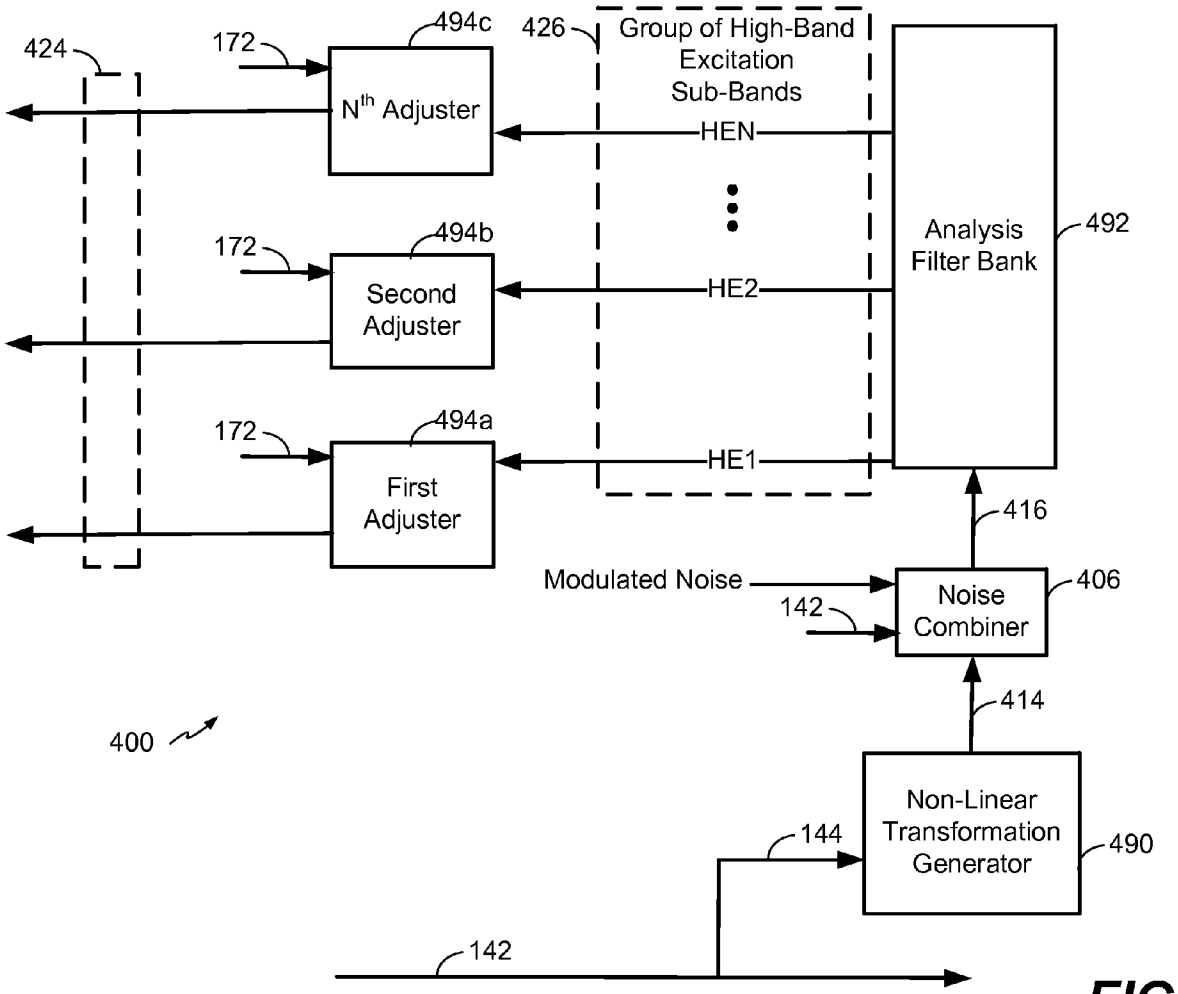
FIG. 4 is a diagram of a particular embodiment of a system that is operable to reconstruct an audio signal using adjustment parameters.

Referring to FIG. 4, a particular embodiment of a system 400 that is operable to reconstruct an audio signal using adjustment parameters is shown. The system 400 includes a non-linear transformation generator 490, a noise combiner 406, an analysis filter bank 492, and N adjusters 494*a*-494*c*. In a particular embodiment, the system 400 may be integrated into a decoding system or apparatus (e.g., in a wireless telephone or CODEC). In other particular embodiments, the system 400 may be integrated into a set top box, a music player, a video player, an entertainment unit, a navigation device, a communications device, a PDA, a fixed location data unit, or a computer.

The non-linear transformation generator 490 may be configured to generate a harmonically extended signal 414 (e.g., a non-linear excitation signal) based on the low-band excitation signal 144 that is received as part of the low-band bit stream 142 in the bit stream 199. The harmonically extended signal 414 may correspond to a reconstructed version of the harmonically extended signal 214 of FIGS. 1-3. For example, the non-linear transformation generator 490 may operate in a substantially similar manner as the non-linear transformation generator 190 of FIGS. 1-3. In the illustrative embodiment, the harmonically extended signal 414 may be provided to the noise combiner 406 in a similar manner as described with respect to FIG. 2. In another particular embodiment, the harmonically extended signal 414 may be provided to the analysis filter bank 492 in a similar manner as described with respect to FIG. 3.

The noise combiner 406 may receive the low-band bit stream 142 and generate a mixing factor, as described with respect the noise combiner 206 of FIG. 2 or the noise combiners 306*a*-306*c* of FIG. 3. Alternatively, the noise combiner 406 may receive high-band side information 172 that includes the mixing factor generated at an encoder (e.g., the systems 100-300 of FIGS. 1-3). In the illustrative embodiment, the noise combiner 406 may mix the transform low-band excitation signal 414 with modulated noise to generate a high-band excitation signal 416 (e.g., a reconstructed version of the high-band excitation signal 216 of FIG. 2) based on the mixing factor. For example, the noise combiner 406 may operate in a substantially similar manner as the noise combiner 206 of FIG. 2. In the illustrative embodiment, the high-band excitation signal 416 may be provided to the analysis filter bank 492.

In the illustrative embodiment, the analysis filter bank 492 may be configured to filter (e.g., split) the high-band excitation signal 416 into a group of high-band excitation sub-bands 426 (e.g., a reconstructed version of the second group of the third group of sub-bands 126 of FIGS. 1-3). For example, the analysis filter bank 492 may operate in a substantially similar manner as the second analysis filter bank 192 as described with respect to FIG. 2. The group of high-band excitation sub-bands 426 may be provided to a corresponding adjuster 494*a*-494*c*.

In another embodiment, the analysis filter bank 492 may be configured to filter the harmonically extended signal 414 into a plurality of sub-bands (not shown) in a similar manner as the second analysis filter bank 192 as described with respect to FIG. 3. In this embodiment, multiple noise combiners (not shown) may combine each sub-band of the plurality of sub-bands with modulated noise (based on a mixing factors transmitted as high-band side information) to generate the group of high-band excitation sub-bands 426 in a similar manner as the noise combiners 394*a*-394*c* of FIG. 3. Each sub-band of the group of high-band excitation sub-bands 426 may be provided to a corresponding adjuster 494*a*-494*c*.

Each adjuster 494*a*-494*c* may receive a corresponding adjustment parameter generated by the parameter estimators 194 of FIG. 1 as high-band side information 172. Each adjuster 494*a*-494*c* may also receive a corresponding sub-band of the group of high-band excitation sub-bands 426. The adjusters 494*a*-494*c* may be configured to generate an adjusted group of high-band excitation sub-bands 424 based on the adjustment parameters. The adjusted group of high-band excitation sub-bands 424 may be provided to other components (not shown) of the system 400 for further processing (e.g., LP synthesis, gain shape adjustment processing, phase adjustment processing, etc.) to reconstruct the second group of sub-bands 124 of FIGS. 1-3.

The system 400 of FIG. 4 may reconstruct the second group of sub-bands 124 using the low-band bit stream 142 of FIG. 1 and the adjustment parameters (e.g., the high-band side information 172 of FIG. 1). Using the adjustment parameters may improve accuracy of reconstruction (e.g., generate a fine-tuned reconstruction) by performing adjustment of the high-band excitation signal 416 on a sub-band by sub-band basis.

Figure 5:
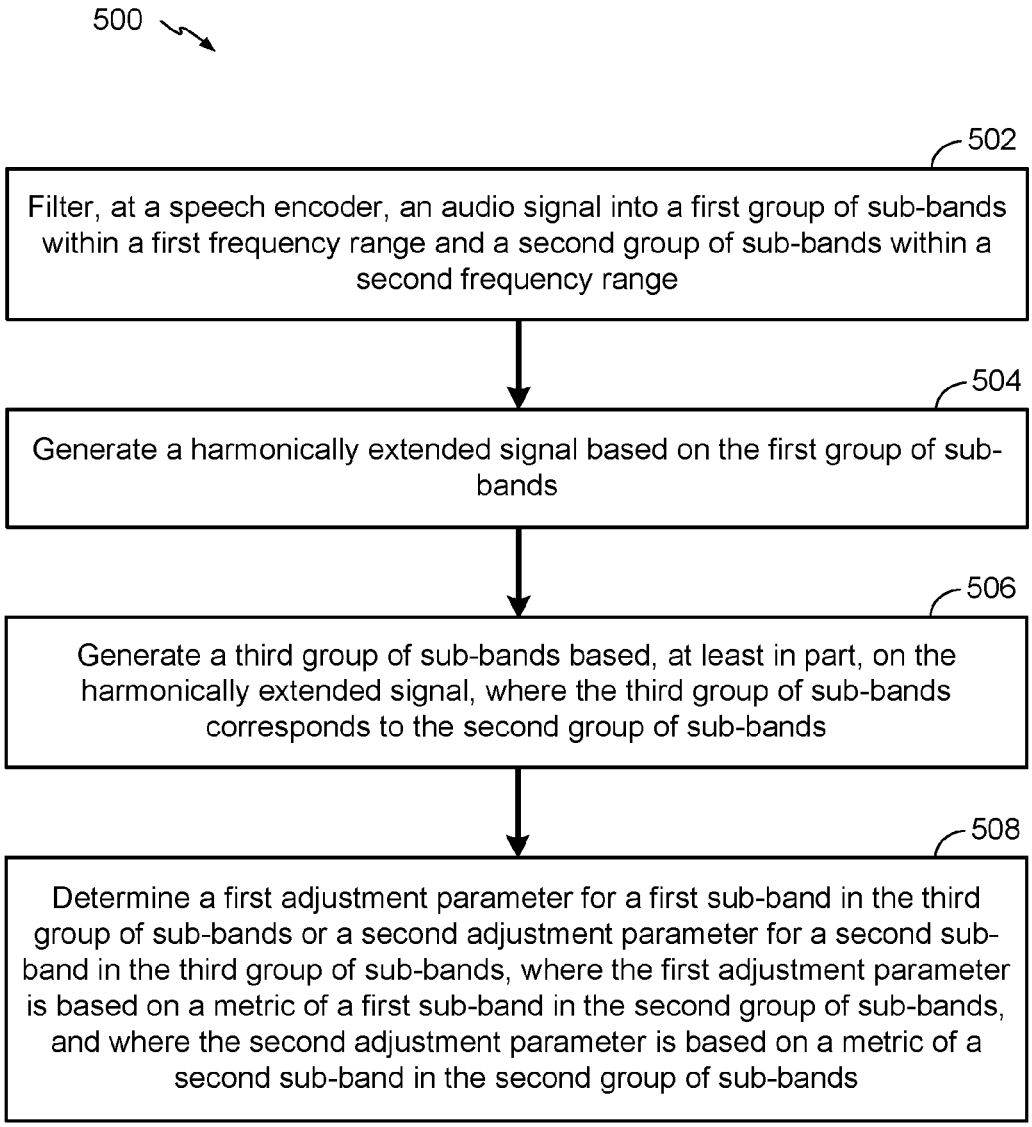
FIG. 5 is a flowchart of a particular embodiment of a method for performing high-band signal modeling.

Referring to FIG. 5, a flowchart of a particular embodiment of a method 500 for performing high-band signal modeling is shown. As an illustrative example, the method 500 may be performed by one or more of the systems 100-300 of FIGS. 1-3.

The method 500 may include filtering, at a speech encoder, an audio signal into a first group of sub-bands within a first frequency range and a second group of sub-bands within a second frequency range, at 502. For example, referring to FIG. 1, the first analysis filter bank 110 may filter the input audio signal 102 into the first group of sub-bands 122 within the first frequency range and the second group of sub-bands 124 within the second frequency range. The first frequency range may be lower than the second frequency range.

A harmonically extended signal may be generated based on the first group of sub-bands, at 504. For example, referring to FIGS. 2-3, the synthesis filter bank 202 may generate the low-band signal 212 by combining the first group of sub-bands 122, and the low-band coder 204 may encode the low-band signal 212 to generate the low-band excitation signal 144. The low-band excitation signal 144 may be provided to the non-linear transformation generator 407. The non-linear transformation generator 190 may up-sample the low-band excitation signal 144 to generate the harmonically extended signal 214 (e.g., a non-linear excitation signal) based on the low-band excitation signal 144 (e.g., the first group of sub-bands 122).

A third group of sub-bands may be generated based, at least in part, on the harmonically extended signal, at 506. For example, referring to FIG. 2, the harmonically extended signal 214 may be mixed with modulated noise to generate the high-band excitation signal 216. The second filter analysis filter bank 192 may filter (e.g., split) the high-band excitation signal 216 into the third group of sub-bands 126 (e.g., high-band excitation signals) corresponding to the second group of sub-bands 124. Alternatively, referring to FIG. 3, the harmonically extended signal 214 is provided to the second analysis filter bank 192. The second filter analysis filter bank 192 may filter (e.g., split) the harmonically extended signal 214 into the plurality of sub-bands 322. Each sub-band of the plurality of sub-bands 322 may be provided to a corresponding noise combiner 306*a*-306*c*. For example, a first sub-band of the plurality of sub-bands 322 may be provided to the first noise combiner 306*a*, a second sub-band of the plurality of sub-bands 322 may be provided to the second noise combiner 306*b*, etc. Each noise combiner 306*a*-306*c* may mix the received sub-band of the plurality of sub-bands 322 with modulated noise to generate the third group of sub-bands 126.

A first adjustment parameter for a first sub-band in the third group of sub-bands may be determined, or a second adjustment parameter for a second sub-band in the third group of sub-bands may be determined, at 508. For example, referring to FIGS. 2-3, the first parameter estimator 294*a* may determine a first adjustment parameter (e.g., an LPC adjustment parameter and/or a gain adjustment parameter) for the first sub-band (HE1) in the third group of sub-bands 126 based on a metric (e.g., a signal energy, a residual energy, LP coefficients, etc.) of a corresponding sub-band (H1) in the second group of sub-bands 124. The first parameter estimator 294*a* may calculate a first gain factor (e.g., a first adjustment parameter) according to a relation between the first sub-band (HE1) and the first sub-band (H1). The gain factor may correspond to a difference (or ratio) between the energies of the sub-bands (H1, HE1) over a frame or some portion of the frame. In a similar manner, the other parameter estimators 294*b*-294*c* may determine a second adjustment parameter for the second sub-band (HE2) in the third group of sub-bands 126 based on a metric (e.g., a signal energy, a residual energy, LP coefficients, etc.) of the second sub-band (H2) in the second group of sub-bands 124.

The method 500 of FIG. 5 may improve correlation between synthesized high-band signal components (e.g., the third group of sub-bands 126) and original high-band signal components (e.g., the second group of sub-bands 124). For example, spectral and envelope approximation between the synthesized high-band signal components and the original high-band signal components may be performed on a "finer" level by comparing metrics of the second group of sub-bands 124 with metrics of the third group of sub-bands 126 on a sub-band by sub-band basis. The third group of sub-bands 126 may be adjusted based on adjustment parameters resulting from the comparison, and the adjustment parameters may be transmitted to a decoder to reduce audible artifacts during high-band reconstruction of the input audio signal 102.

Figure 6:
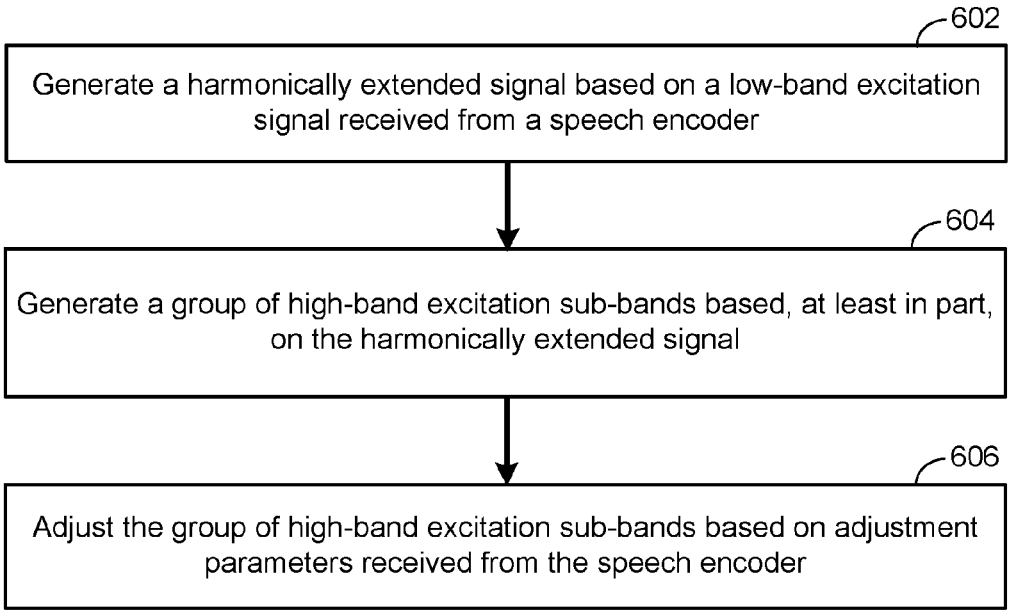
FIG. 6 is a flowchart of a particular embodiment of a method for reconstructing an audio signal using adjustment parameters.

Referring to FIG. 6, a flowchart of a particular embodiment of a method 600 for reconstructing an audio signal using adjustment parameters is shown. As an illustrative example, the method 600 may be performed by the system 400 of FIG. 4.

The method 600 includes generating a harmonically extended signal based on a low-band excitation signal received from a speech encoder, at 602. For example, referring to FIG. 4, the low-band excitation signal 444 may be provided to the non-linear transformation generator 490 to generate the harmonically extended signal 414 (e.g., a non-linear excitation signal) based on the low-band excitation signal 444.

A group of high-band excitation sub-bands may be generated based, at least in part, on the harmonically extended signal, at 606. For example, referring to FIG. 4, the noise combiner 406 may determine a mixing factor based on a pitch lag, an adaptive codebook gain, and/or a pitch correlation between bands, as described with respect to FIG. 4, or may receive high-band side information 172 that includes the mixing factor generated at an encoder (e.g., the systems 100-300 of FIGS. 1-3). The noise combiner 406 may mix the transform low-band excitation signal 414 with modulated noise to generate the high-band excitation signal 416 (e.g., a reconstructed version of the high-band excitation signal 216 of FIG. 2) based on the mixing factor. The analysis filter bank 492 may filter (e.g., split) the high-band excitation signal 416 into a group of high-band excitation sub-bands 426 (e.g., a reconstructed version of the second group of the third group of sub-bands 126 of FIGS. 1-3).

The group of high-band excitation sub-bands may be adjusted based on adjustment parameters received from the speech encoder, at 608. For example, referring to FIG. 4, each adjuster 494*a*-494*c* may receive a corresponding adjustment parameter generated by the parameter estimators 194 of FIG. 1 as high-band side information 172. Each adjuster 494*a*-494*c* may also receive a corresponding sub-band of the group of high-band excitation sub-bands 426. The adjusters 494*a*-494*c* may generate the adjusted group of high-band excitation sub-bands 424 based on the adjustment parameters. The adjusted group of high-band excitation sub-bands 424 may be provided to other components (not shown) of the system 400 for further processing (e.g., gain shape adjustment processing, phase adjustment processing, etc.) to reconstruct the second group of sub-bands 124 of FIGS. 1-3.

The method 600 of FIG. 6 may reconstruct the second group of sub-bands 124 using the low-band bit stream 142 of FIG. 1 and the adjustment parameters (e.g., the high-band side information 172 of FIG. 1). Using the adjustment parameters may improve accuracy of reconstruction (e.g., generate a fine-tuned reconstruction) by performing adjustment of the high-band excitation signal 416 on a sub-band by sub-band basis.

In particular embodiments, the methods 500, 600 of FIGS. 5-6 may be implemented via hardware (e.g., a FPGA device, an ASIC, etc.) of a processing unit, such as a central processing unit (CPU), a DSP, or a controller, via a firmware device, or any combination thereof. As an example, the methods 500, 600 of FIGS. 5-6 can be performed by a processor that executes instructions, as described with respect to FIG. 7.

Figure 7:
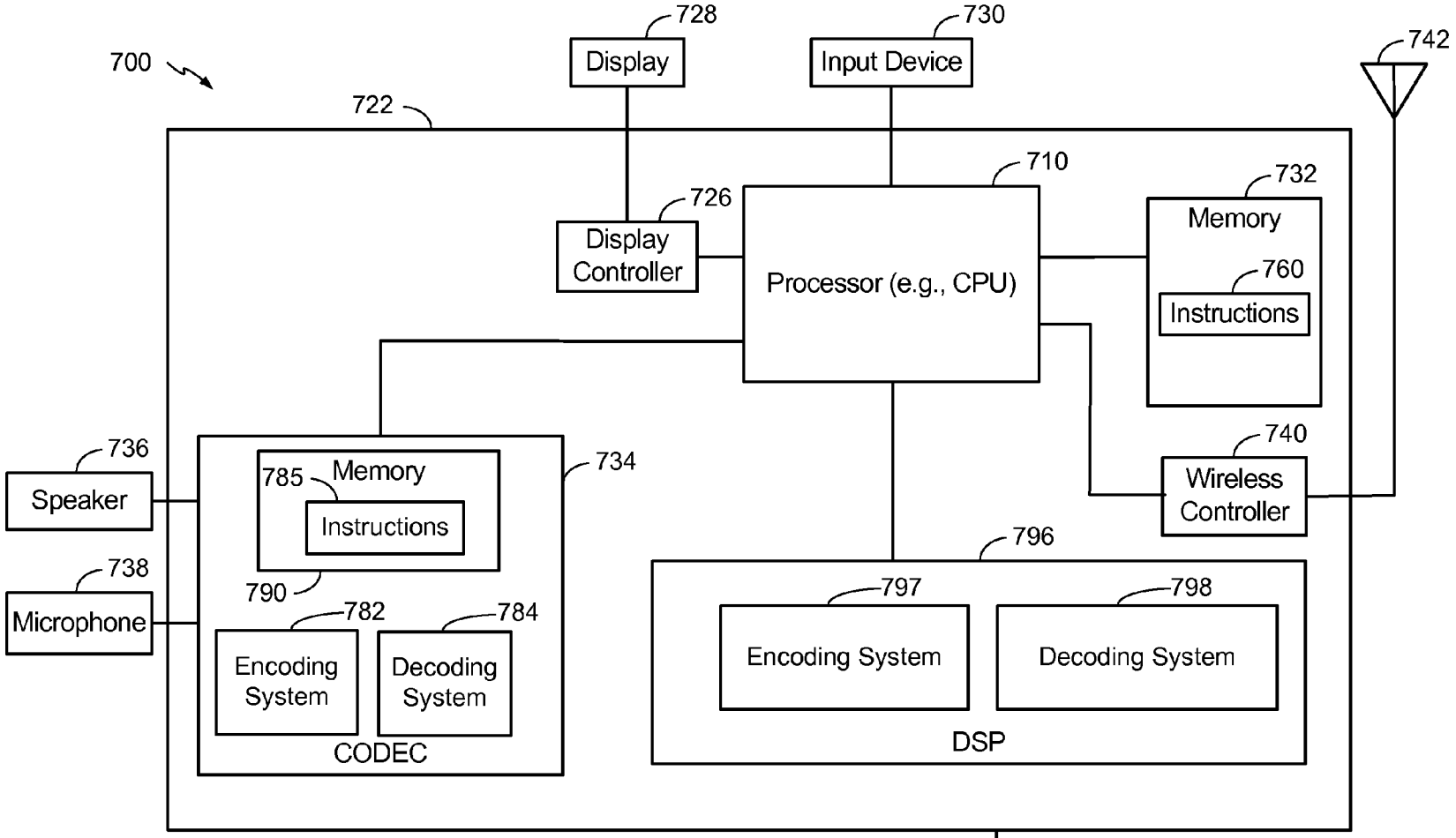
FIG. 7 is a block diagram of a wireless device operable to perform signal processing operations in accordance with the systems and methods of FIGS. 1-6.

Referring to FIG. 7, a block diagram of a particular illustrative embodiment of a wireless communication device is depicted and generally designated 700. The device 700 includes a processor 710 (e.g., a CPU) coupled to a memory 732. The memory 732 may include instructions 760 executable by the processor 710 and/or a CODEC 734 to perform methods and processes disclosed herein, such as one or both of the methods 500, 600 of FIGS. 5-6.

In a particular embodiment, the CODEC 734 may include an encoding system 782 and a decoding system 784. In a particular embodiment, the encoding system 782 includes one or more components of the systems 100-300 of FIGS. 1-3. For example, the encoding system 782 may perform encoding operations associated with the systems 100-300 of FIGS. 1-3 and the method 500 of FIG. 5. In a particular embodiment, the decoding system 784 may include one or more components of the system 400 of FIG. 4. For example, the decoding system 784 may perform decoding operations associated with the system 400 of FIG. 4 and the method 600 of FIG. 6.

The encoding system 782 and/or the decoding system 784 may be implemented via dedicated hardware (e.g., circuitry), by a processor executing instructions to perform one or more tasks, or a combination thereof. As an example, the memory 732 or a memory 790 in the CODEC 734 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 760 or the instructions 785) that, when executed by a computer (e.g., a processor in the CODEC 734 and/or the processor 710), may cause the computer to perform at least a portion of one of the methods 500, 600 of FIGS. 5-6. As an example, the memory 732 or the memory 790 in the CODEC 734 may be a non-transitory computer-readable medium that includes instructions (e.g., the instructions 760 or the instructions 795, respectively) that, when executed by a computer (e.g., a processor in the CODEC 734 and/or the processor 710), cause the computer perform at least a portion of one of the methods 500, 600 of FIGS. 5-6.

The device 700 may also include a DSP 796 coupled to the CODEC 734 and to the processor 710. In a particular embodiment, the DSP 796 may include an encoding system 797 and a decoding system 798. In a particular embodiment, the encoding system 797 includes one or more components of the systems 100-300 of FIGS. 1-3. For example, the encoding system 797 may perform encoding operations associated with the systems 100-300 of FIGS. 1-3 and the method 500 of FIG. 5. In a particular embodiment, the decoding system 798 may include one or more components of the system 400 of FIG. 4. For example, the decoding system 798 may perform decoding operations associated with the system 400 of FIG. 4 and the method 600 of FIG. 6.

FIG. 7 also shows a display controller 726 that is coupled to the processor 710 and to a display 728. The CODEC 734 may be coupled to the processor 710, as shown. A speaker 736 and a microphone 738 can be coupled to the CODEC 734. For example, the microphone 738 may generate the input audio signal 102 of FIG. 1, and the CODEC 734 may generate the output bit stream 199 for transmission to a receiver based on the input audio signal 102. For example, the output bit stream 199 may be transmitted to the receiver via the processor 710, a wireless controller 740, and an antenna 742. As another example, the speaker 736 may be used to output a signal reconstructed by the CODEC 734 from the output bit stream 199 of FIG. 1, where the output bit stream 199 is received from a transmitter (e.g., via the wireless controller 740 and the antenna 742).

In a particular embodiment, the processor 710, the display controller 726, the memory 732, the CODEC 734, and the wireless controller 740 are included in a system-in-package or system-on-chip device (e.g., a mobile station modem (MSM)) 722. In a particular embodiment, an input device 730, such as a touchscreen and/or keypad, and a power supply 744 are coupled to the system-on-chip device 722. Moreover, in a particular embodiment, as illustrated in FIG. 7, the display 728, the input device 730, the speaker 736, the microphone 738, the antenna 742, and the power supply 744 are external to the system-on-chip device 722. However, each of the display 728, the input device 730, the speaker 736, the microphone 738, the antenna 742, and the power supply 744 can be coupled to a component of the system-on-chip device 722, such as an interface or a controller.

In conjunction with the described embodiments, a first apparatus is disclosed that includes means for filtering an audio signal into a first group of sub-bands within a first frequency range and a second group of sub-bands within a second frequency range. For example, the means for filtering the audio signal may include the first analysis filter bank 110 of FIGS. 1-3, the encoding system 782 of FIG. 7, the encoding system 797 of FIG. 7, one or more devices configured to filter the audio signal (e.g., a processor executing instructions at a non-transitory computer readable storage medium), or any combination thereof.

The first apparatus may also include means for generating a harmonically extended signal based on the first group of sub-bands. For example, the means for generating the harmonically extended signal may include the low-band analysis module 130 of FIG. 1 and the components thereof, the non-linear transformation generator 190 of FIGS. 1-3, the synthesis filter bank 202 of FIGS. 2-3, the low-band coder 204 of FIGS. 2-3, the encoding system 782 of FIG. 7, the encoding system 797 of FIG. 7, one or more devices configured to generate the harmonically extended signal (e.g., a processor executing instructions at a non-transitory computer readable storage medium), or any combination thereof.

The first apparatus may also include means for generating a third group of sub-bands based, at least in part, on the harmonically extended signal. For example, the means for generating the third group of sub-bands may include the high-band analysis module 150 of FIG. 1 and the components thereof, the second analysis filter bank 192 of FIGS. 1-3, the noise combiner 206 of FIG. 2, the noise combiners **306*a*-306*c* of FIG. 3, the encoding system 782 of FIG. 7**, one or more devices configured to generate the third group of sub-bands (e.g., a processor executing instructions at a non-transitory computer readable storage medium), or any combination thereof.

The first apparatus may also include means for determining a first adjustment parameter for a first sub-band in the third group of sub-bands or a second adjustment parameter for a second sub-band in the third group of sub-bands. For example, the means for determining the first and second adjustment parameters may include the parameter estimators 194 of FIG. 1, the parameter estimators 294*a*-294*c* of FIG. 2, the encoding system 782 of FIG. 7, the encoding system 797 of FIG. 7, one or more devices configured to determine the first and second adjustment parameters (e.g., a processor executing instructions at a non-transitory computer readable storage medium), or any combination thereof.

In conjunction with the described embodiments, a second apparatus is disclosed that includes means for generating a harmonically extended signal based on a low-band excitation signal received from a speech encoder. For example, the means for generating the harmonically extended signal may include the non-linear transformation generator 490 of FIG. 4, the decoding system 784 of FIG. 7, the decoding system 798 of FIG. 7, one or more devices configured to generate the harmonically extended signal (e.g., a processor executing instructions at a non-transitory computer readable storage medium), or any combination thereof.

The second apparatus may also include means for generating a group of high-band excitation sub-bands based, at least in part, on the harmonically extended signal. For example, the means for generating the group of high-band excitation sub-bands may include the noise combiner 406 of FIG. 4, the analysis filter bank 492 of FIG. 4, the decoding system 784 of FIG. 7, the decoding system 798 of FIG. 7, one or more devices configured to generate the group of high-band excitation signals (e.g., a processor executing instructions at a non-transitory computer readable storage medium), or any combination thereof.

The second apparatus may also include means for adjusting the group of high-band excitation sub-bands based on adjustment parameters received from the speech encoder. For example, the means for adjusting the group of high-band excitation sub-bands may include the adjusters 494*a*-494*c* of FIG. 4, the decoding system 784 of FIG. 7, the decoding system 798 of FIG. 7, one or more devices configured to adjust the group of high-band excitation sub-bands (e.g., a processor executing instructions at a non-transitory computer readable storage medium), or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method of reducing a transmission bandwidth of a bit stream, the method comprising:

filtering, at a speech encoder, an audio signal into a group of low-frequency sub-bands within a low-band frequency range and a first group of high-frequency sub-bands within a high-band frequency range;

generating a first residual signal of a first high-frequency sub-band in the first group of high-frequency sub-bands;

generating a harmonically extended signal based on the group of low-frequency sub-bands and a non-linear processing function;

generating a second group of high-frequency sub-bands based, at least in part, on the harmonically extended signal, wherein the second group of high-frequency sub-bands corresponds to the first group of high-frequency sub-bands;

determining, at a dedicated parameter estimator, a first adjustment parameter based on a comparison of an energy level associated with the first residual signal to an energy level of a first high-frequency sub-band in the second group of high-frequency sub-bands;

determining a second adjustment parameter for a second high-frequency sub-band in the second group of high-frequency sub-bands based on a metric of a second high-frequency sub-band in the first group of high-frequency sub-bands; and transmitting the first adjustment parameter and the second adjustment parameter to a speech decoder as part of the bit stream, the first adjustment parameter and the second adjustment parameter usable by the speech decoder to reconstruct the first group of high-frequency sub-bands, wherein the transmission bandwidth of the bit stream is reduced compared to transmission of an encoded version of the first group of high-frequency sub-bands.

2. The method of claim 1, wherein the first adjustment parameter and the second adjustment parameter correspond to gain adjustment parameters.

3. The method of claim 1, wherein the first adjustment parameter and the second adjustment parameter correspond to linear prediction coefficient adjustment parameters.

4. The method of claim 1, wherein the first adjustment parameter and the second adjustment parameter correspond to time varying envelope adjustment parameters.

5. The method of claim 1, further comprising inserting the first adjustment parameter and the second adjustment parameter into an encoded version of the audio signal to enable adjustment during reconstruction of the audio signal from the encoded version of the audio signal.

6. The method of claim 1, wherein generating the second group of high-frequency sub-bands comprises:

mixing the harmonically extended signal with modulated noise to generate a high-band excitation signal, wherein the modulated noise and the harmonically extended signal are mixed based on a mixing factor; and filtering the high-band excitation signal into the second group of high-frequency sub-bands.

7. The method of claim 6, wherein the mixing factor is determined based on at least one among a pitch lag, an adaptive codebook gain associated with the group of low-frequency sub-bands, a pitch correlation between the group of low-frequency sub-bands and the first group of high-frequency sub-bands.

8. The method of claim 1, wherein generating the second group of high-frequency sub-bands comprises:

filtering the harmonically extended signal into a plurality of sub-bands; and mixing each sub-band of the plurality of sub-bands with modulated noise to generate a plurality of high-band excitation signals, wherein the plurality of high-band excitation signals corresponds to the second group of high-frequency sub-bands.

9. The method of claim 8, wherein the modulated noise and a first sub-band of the plurality of sub-bands are mixed based on a first mixing factor, and wherein the modulated noise and a second sub-band of the plurality of sub-bands are mixed based on a second mixing factor.

10. An apparatus for reducing a transmission bandwidth of a bit stream, the apparatus comprising:

a first filter configured to filter an audio signal into a group of low-frequency sub-bands within a low-band frequency range and a first group of high-frequency sub-bands within a high-band frequency range;

a parameter estimator configured to generate a first residual signal of a first high-frequency sub-band in the first group of high-frequency sub-bands;

a non-linear transformation generator configured to generate a harmonically extended signal based on the group of low-frequency sub-bands and a non-linear processing function;

a second filter configured to generate a second group of high-frequency sub-bands based, at least in part, on the harmonically extended signal, wherein the second group of high-frequency sub-bands corresponds to the first group of high-frequency sub-bands;

dedicated parameter estimators configured to:

determine a first adjustment parameter based on a comparison of an energy level associated with the first residual signal to an energy level of a first high-frequency sub-band in the second group of high-frequency sub-bands; and determine a second adjustment parameter for a second high-frequency sub-band in the second group of high-frequency sub-bands based on a metric of a second high-frequency sub-band in the first group of high-frequency sub-bands; and a transmitter to transmit the first adjustment parameter and the second adjustment parameter to a speech decoder as part of the bit stream, the first adjustment parameter and the second adjustment parameter usable by the speech decoder to reconstruct the first group of high-frequency sub-bands, wherein the transmission bandwidth of the bit stream is reduced compared to transmission of an encoded version of the first group of high-frequency sub-bands.

11. The apparatus of claim 10, wherein the first adjustment parameter and the second adjustment parameter correspond to gain adjustment parameters.

12. The apparatus of claim 10, wherein the first adjustment parameter and the second adjustment parameter correspond to linear prediction coefficient adjustment parameters.

13. The apparatus of claim 10, wherein the first adjustment parameter and the second adjustment parameter correspond to time varying envelope adjustment parameters.

14. The apparatus of claim 10, further comprising a multiplexer configured to insert the first adjustment parameter and the second adjustment parameter into an encoded version of the audio signal to enable adjustment during reconstruction of the audio signal from the encoded version of the audio signal.

15. The apparatus of claim 10, wherein generating the second group of high-frequency sub-bands comprises:

mixing the harmonically extended signal with modulated noise to generate a high-band excitation signal, wherein the modulated noise and the harmonically extended signal are mixed based on a mixing factor; and filtering the high-band excitation signal into the second group of high-frequency sub-bands.

16. The apparatus of claim 15, wherein the mixing factor is determined based on at least one among a pitch lag, an adaptive codebook gain associated with the group of low-frequency sub-bands, and a pitch correlation between the group of low-frequency sub-bands and the first group of high-frequency sub-bands.

17. The apparatus of claim 10, wherein generating the second group of high-frequency sub-bands comprises:

filtering the harmonically extended signal into a plurality of sub-bands; and mixing each sub-band of the plurality of sub-bands with modulated noise to generate a plurality of high-band excitation signals, wherein the plurality of high-band excitation signals corresponds to the second group of high-frequency sub-bands.

18. The apparatus of claim 17, wherein the modulated noise and a first sub-band of the plurality of sub-bands are mixed based on a first mixing factor, and wherein the modulated noise and a second sub-band of the plurality of sub-bands are mixed based on a second mixing factor.

19. A non-transitory computer-readable medium comprising instructions for reducing a transmission bandwidth of a bit stream, wherein the instructions, when executed by a processor at a speech encoder, cause the processor to:

filter an audio signal into a group of low-frequency sub-bands within a low-band frequency range and a first group of high-frequency sub-bands within a high-band frequency range;

generate a first residual signal of a first sub-band in the first group of high-frequency sub-bands;

generate a harmonically extended signal based on the group of low-frequency sub-bands and a non-linear processing function;

generate a second group of high-frequency sub-bands based, at least in part, on the harmonically extended signal, wherein the second group of high-frequency sub-bands corresponds to the first group of high-frequency sub-bands;

determine, at a dedicated parameter estimator, a first adjustment parameter based on a comparison of an energy level associated with the first residual signal to an energy level of a first high-frequency sub-band in the second group of high-frequency sub-bands;

determine a second adjustment parameter for a second high-frequency sub-band in the second group of high-frequency sub-bands based on a metric of a second high-frequency sub-band in the first group of high-frequency sub-bands; and initiate transmission of the first adjustment parameter and the second adjustment parameter to a speech decoder as part of the bit stream, wherein the first adjustment parameter and the second adjustment parameter are usable by the speech decoder to reconstruct the first group of high-frequency sub-bands, and wherein the transmission bandwidth of the bit stream is reduced compared to transmission of an encoded version of the first group of high-frequency sub-bands.

20. The non-transitory computer-readable medium of claim 19, wherein the first adjustment parameter and the second adjustment parameter correspond to gain adjustment parameters.

21. The non-transitory computer-readable medium of claim 19, wherein the first adjustment parameter and the second adjustment parameter correspond to linear prediction coefficient adjustment parameters.

22. The non-transitory computer-readable medium of claim 19, wherein the first adjustment parameter and the second adjustment parameter correspond to time varying envelope adjustment parameters.

23. The non-transitory computer-readable medium of claim 19, further comprising instructions that, when executed by the processor, cause the processor to insert the first adjustment parameter and the second adjustment parameter into an encoded version of the audio signal to enable adjustment during reconstruction of the audio signal from the encoded version of the audio signal.

24. An apparatus for reducing a transmission bandwidth of a bit stream, the apparatus comprising:

means for filtering an audio signal into a group of low-frequency sub-bands within a low-band frequency range and a first group of high-frequency sub-bands within a high-band frequency range;

means for generating a first residual signal of a first high-frequency sub-band in the first group of high-frequency sub-bands;

means for generating a harmonically extended signal based on the group of low-frequency sub-bands and a non-linear processing function;

means for generating a second group of high-frequency sub-bands based, at least in part, on the harmonically extended signal, wherein the second group of high-frequency sub-bands corresponds to the first group of high-frequency sub-bands;

means for determining a first adjustment parameter based on a comparison of an energy level associated with the first residual signal to an energy level of a first high-frequency sub-band in the second group of high-frequency sub-bands;

means for determining a second adjustment parameter for a second high-frequency sub-band in the second group of high-frequency sub-bands based on a metric of a second high-frequency sub-band in the first group of high-frequency sub-bands; and means for transmitting the first adjustment parameter and the second adjustment parameter to a speech decoder as part of the bit stream, the first adjustment parameter and the second adjustment parameter usable by the speech decoder to reconstruct the first group of high-frequency sub-bands, wherein the transmission bandwidth of the bit stream is reduced compared to transmission of an encoded version of the first group of high-frequency sub-bands.

25. The apparatus of claim 24, wherein the first adjustment parameter and the second adjustment parameter correspond to gain adjustment parameters.

26. The apparatus of claim 24, wherein the first adjustment parameter and the second adjustment parameter correspond to linear prediction coefficient adjustment parameters.

27. The apparatus of claim 24, wherein the first adjustment parameter and the second adjustment parameter correspond to time varying envelope adjustment parameters.

28. The apparatus of claim 24, further comprising means for inserting the first adjustment parameter and the second adjustment parameter into an encoded version of the audio signal to enable adjustment during reconstruction of the audio signal from the encoded version of the audio signal.

29. A method comprising:

generating, at a speech decoder, a harmonically extended signal based on a low-band excitation signal, wherein the low-band excitation signal is generated by a linear prediction based decoder based on parameters received from a speech encoder;

generating a group of high-band excitation sub-bands based, at least in part, on the harmonically extended signal;

adjusting, at a dedicated parameter adjuster, the group of high-band excitation sub-bands based on adjustment parameters received from the speech encoder, wherein a transmission bandwidth of a bit stream is reduced compared to transmission of an encoded version of high-frequency sub-bands of an encoder-side audio signal, and wherein the adjustment parameters comprise:

a first adjustment parameter based on a comparison of an energy level of a first high-frequency sub-band in a group of high-frequency sub-bands to an energy level associated with a residual signal of a first high-frequency sub-band in a second group of high-frequency; and a second adjustment parameter for a second high-frequency sub-band in the group of high-frequency sub-bands; and reconstructing the high-frequency sub-bands of the encoder-side audio signal based on the adjusted group of high-band excitation sub-bands.

30. The method of claim 29, wherein the adjustment parameters include gain adjustment parameters, linear predication coefficient adjustment parameters, time varying envelope adjustment parameters, or a combination thereof.

31. An apparatus comprising:

a non-linear transformation generator configured to generate a harmonically extended signal based on a low-band excitation signal, wherein the low-band excitation signal is generated by a linear prediction based decoder based on parameters received from a speech encoder;

a second filter configured to generate a group of high-band excitation sub-bands based, at least in part, on the harmonically extended signal;

dedicated parameter adjusters configured to adjust the group of high-band excitation sub-bands based on adjustment parameters received from the speech encoder, wherein a transmission bandwidth of a bit stream is reduced compared to transmission of an encoded version of high-frequency sub-bands of an encoder-side audio signal, and wherein the adjustment parameters comprise:

a first adjustment parameter based on a comparison of an energy level of a first high-frequency sub-band in a group of high-frequency sub-bands to an energy level associated with a residual signal of a first high-frequency sub-band in a second group of high-frequency; and a second adjustment parameter for a second high-frequency sub-band in the group of high-frequency sub-bands; and a reconstruction unit configured to reconstruct the high-frequency sub-bands of the encoder-side audio signal based on the adjusted group of high-band excitation sub-bands.

32. The apparatus of claim 31, wherein the adjustment parameters include gain adjustment parameters, linear predication coefficient adjustment parameters, time varying envelope adjustment parameters, or a combination thereof.

33. An apparatus comprising:

means for generating a harmonically extended signal based on a low-band excitation signal, wherein the low-band excitation signal is generated by a linear prediction based decoder based on parameters received from a speech encoder;

means for generating a group of high-band excitation sub-bands based, at least in part, on the harmonically extended signal;

means for adjusting the group of high-band excitation sub-bands based on adjustment parameters received from the speech encoder, wherein a transmission bandwidth of a bit stream is reduced compared to transmission of an encoded version of high-frequency sub-bands of an encoder-side audio signal, and wherein the adjustment parameters comprise:

a first adjustment parameter based on a comparison of an energy level of a first high-frequency sub-band in a group of high-frequency sub-bands to an energy level associated with a residual signal of a first high-frequency sub-band in a second group of high-frequency; and a second adjustment parameter for a second high-frequency sub-band in the group of high-frequency sub-bands; and means for reconstructing the high-frequency sub-bands of the encoder-side audio signal based on the adjusted group of high-band excitation sub-bands.

34. The apparatus of claim 33, wherein the adjustment parameters include gain adjustment parameters, linear predication coefficient adjustment parameters, time varying envelope adjustment parameters, or a combination thereof.

35. A non-transitory computer-readable medium comprising instructions that, when executed by a processor at a speech decoder, cause the processor to:

generate a harmonically extended signal based on a low-band excitation signal, wherein the low-band excitation signal is generated by a linear prediction based decoder based on parameters received from a speech encoder;

generate a group of high-band excitation sub-bands based, at least in part, on the harmonically extended signal; and adjust, at a dedicated parameter adjuster, the group of high-band excitation sub-bands based on adjustment parameters received from the speech encoder, wherein a transmission bandwidth of a bit stream is reduced compared to transmission of an encoded version of high-frequency sub-bands of an encoder-side audio signal, and wherein the adjustment parameters comprise:

a first adjustment parameter based on a comparison of an energy level of a first high-frequency sub-band in a group of high-frequency sub-bands to an energy level associated with a residual signal of a first high-frequency sub-band in a second group of high-frequency; and a second adjustment parameter for a second high-frequency sub-band in the group of high-frequency sub-bands; and reconstruct the high-frequency sub-bands of the encoder-side audio signal based on the adjusted group of high-band excitation sub-bands.

* * * * *